United States Patent [19]

Hefer et al.

[11] Patent Number: 4,893,445

[45] Date of Patent: Jan. 16, 1990

[54] CONSTRUCTION SYSTEM

[75] Inventors: Hans G. Hefer, New South Wales, Australia; Jurgen Schneider, Schaumenstein, Fed. Rep. of Germany

[73] Assignee: M.A.H. Construction & Engineering Ply-Ltd., Smithfield, Australia

[21] Appl. No.: 188,170

[22] Filed: Apr. 28, 1988

Related U.S. Application Data

[63] Continuation of Ser. No. 894,291, Aug. 7, 1986, abandoned.

[30] Foreign Application Priority Data

Aug. 7, 1985 [AU] Australia ..... PH01829

[51] Int. Cl.[4] ..... E04H 7/30

[52] U.S. Cl. ..... 52/234; 52/192; 52/284; 52/730; 52/731; 52/587

[58] Field of Search ..... 52/578, 579, 584, 721, 52/730, 731, 582, 648, 192–197, 234, 273, 275–279, 280, 284

[56] References Cited

U.S. PATENT DOCUMENTS

| | | | |
|---|---|---|---|
| 3,327,870 | 6/1967 | Fairchild, Jr. | 52/234 X |
| 3,706,169 | 12/1972 | Rensch | 52/731 X |

FOREIGN PATENT DOCUMENTS

| | | | |
|---|---|---|---|
| 817191 | 8/1951 | Fed. Rep. of Germany | 52/578 |
| 3007201 | 9/1980 | Fed. Rep. of Germany . | |
| 453363 | 11/1949 | Italy | 52/731 |
| 318238 | 1/1972 | U.S.S.R. | 52/731 |

*Primary Examiner*—Richard E. Chilcot, Jr.
*Attorney, Agent, or Firm*—Bryan, Cave, McPheeters & McRoberts

[57] ABSTRACT

The invention discloses a building element and system useful in the construction of silos and other compartmentalized structures; the system comprising a first upright elongated plate 1 having a flange 3 along each of two longitudinal edges at approximately 45 degrees from the plate, the included angle between the flanges being approximately ninety degrees; wall panels 4 having a flange adjacent each of two opposing parallel edges adapted to be sandwiched between one flange of a first upstanding elongated plate and an opposing flat surface on a second upright elongated plate; two or more upstanding plates serving to define a column support.

4 Claims, 3 Drawing Sheets

CONSTRUCTION SYSTEM

This is a continuation of U.S. application Ser. No. 894,291, filed Aug. 7, 1986, now abandoned.

The present invention relates to a construction system and in particular to a set of building elements which are particularly useful in the construction of silos.

Silos are traditionally constructed from vertical panels having horizontal corrugations and having each vertical end welded to a face plate which face plate forms part of a vertical supporting column which column in turn may support adjacent vertical panels. The columns may additionally be filled with concrete and additional reinforcement.

Silos manufactured in accordance with the last mentioned prior art are however relatively complex to manufacture insofar as it is necessary to weld face plates to the ends of the vertical panels. It is additionally necessary to employ bolts, welded flat irons, hooks or other means to join adjacent face plates so as to form a column.

It is the object of the present invention to provide a system of building elements suitable for use in the construction of a silo which require a minimum of welding and yet may be relatively easily and quickly asembled.

The present invention discloses a building element comprising an elongated plate having a flange along each of two longitudinal edges at approximately 45 degrees from the plate the included angle between the flanges being approximately ninety degrees.

The present invention further discloses a building system comprising a first upright elongated plate having a flange along each of two longitudinal edges at approximately 45 degrees from the plate, the included angle between the flanges being approximately ninety degrees; wall panels having a flange adjacent each of two opposing parallel edges adapted to be sandwiched between one flange of the first upstanding elongated plate and an opposing flat surface on a second upstanding elongated member, two or more upright elongated plates serving to define a column support.

One embodiment of the present invention will now be described with reference to the accompanying drawings in which.

Figure 1:
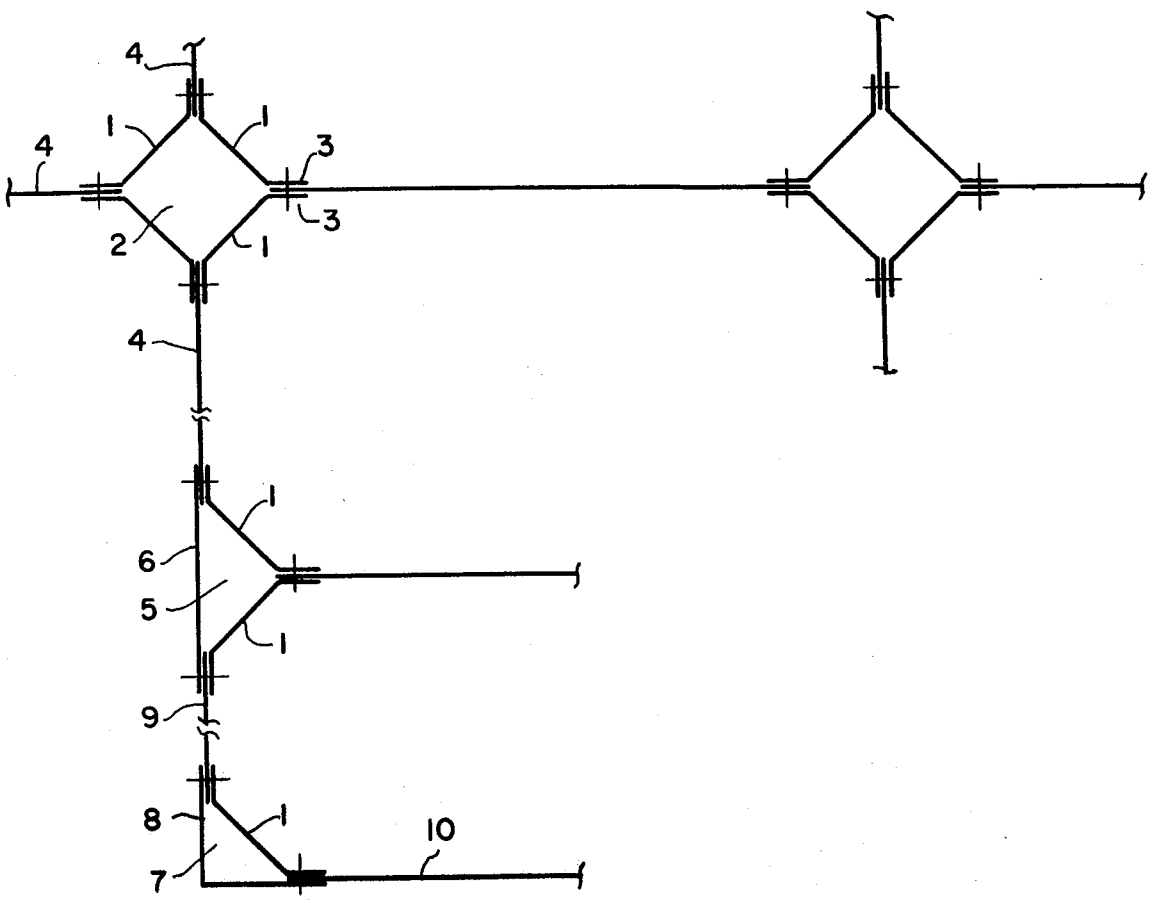
FIG. 1 is a schematic horizontal section through part of a silo constructed in accordance with the present invention.

The diagram in FIG. 1 is intended to disclose the versatility of the basic building element 1 of the present invention. The diagram depicts part of a multi component silo in horizontal section. Basic building element 1 may be utilised to form a diamond shaped vertical support column 2. Support column 2 comprises four basic building elements 1, the flanges 3 of adjacent basic building elements sandwiching vertical wall panels 4. It may be seen that column 2 supports one edge of each of four such wall panels. It is envisaged that the two flanges sandwiching the wall panel would be bolted through thus captivating the wall panel. The basic building element 1 may however be used to form a column of triangular section where such column is intended to merely support three wall panels as depicted at column 5. In this instance a plate 6 is employed in addition to two basic building elements 1 in order to form the closed column and captivate and secure the edges of the wall panels concerned. Column 7 is an example of a corner column only required to support two vertical edges of two wall panels such column comprising a standard building element 1 together with a right angle corner plate 8 bolted together and sandwiching one edge of each of two wall panels 9 and 10.

Figure 2:
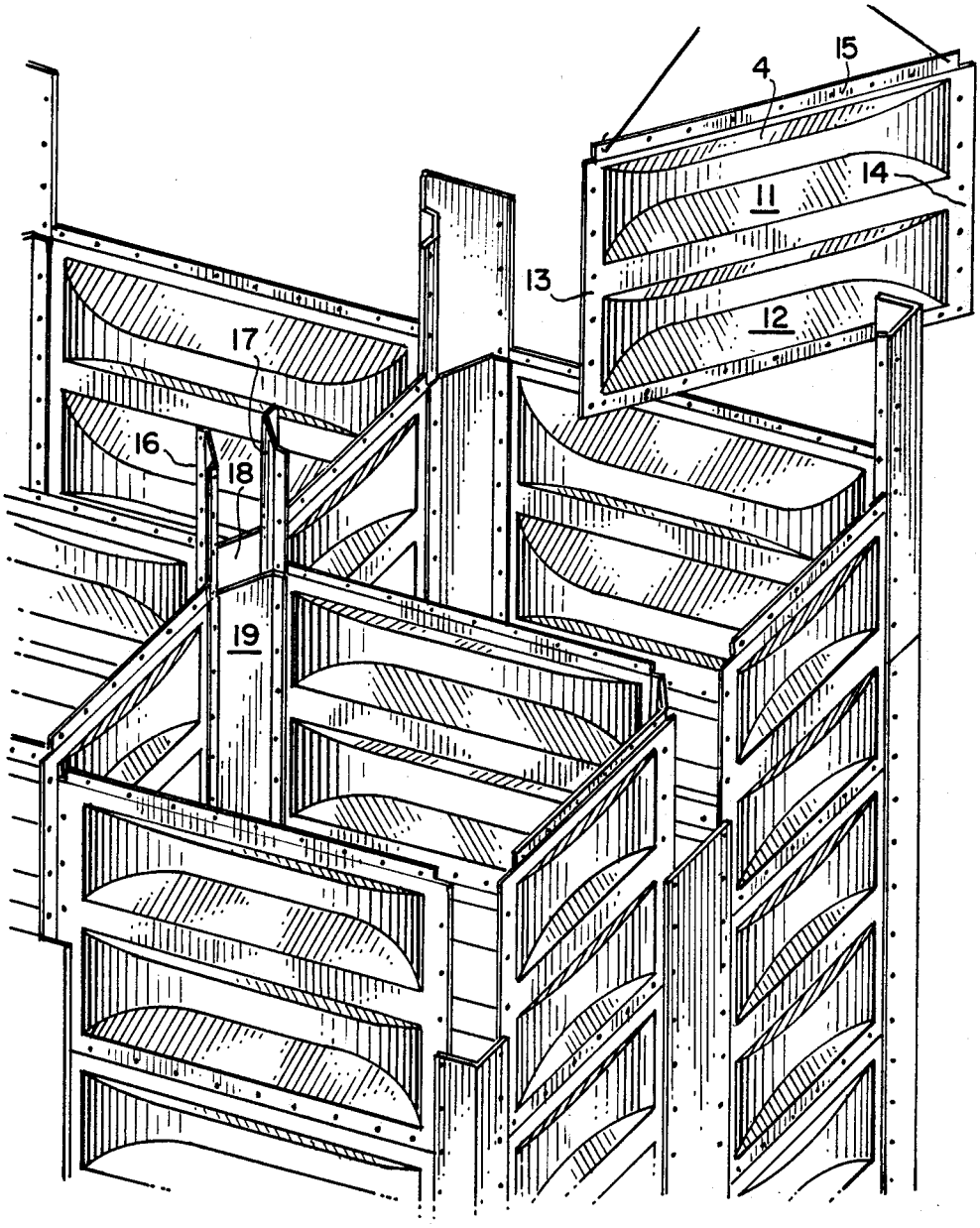
FIG. 2 is a perspective view of a silo in accordance with the present invention under construction.

FIG. 2 depicts a multi compartment silo partially constructed showing a wall panel 4 developed specifically for use in conjunction with the present system of construction. The panel is pressed so as to display two profiled strengthening sections 11 and 12 together with flat flanges at each of ends 13 and 14 adapted to be sandwiched between the building elements of a column. The upper flange 15 is offset so as to be capable of lying side by side with the lower flange of the wall panel above rather than merely abutting same which abutment would preclude bolting.

It may be seen from FIG. 2 that the elements comprising the vertical columns are staggered in order to avoid undue weakening. For example opposing basic building elements 16 and 17 terminate well above the other pair of opposing basic building elements 18 and 19 forming the one column.

Figure 3:
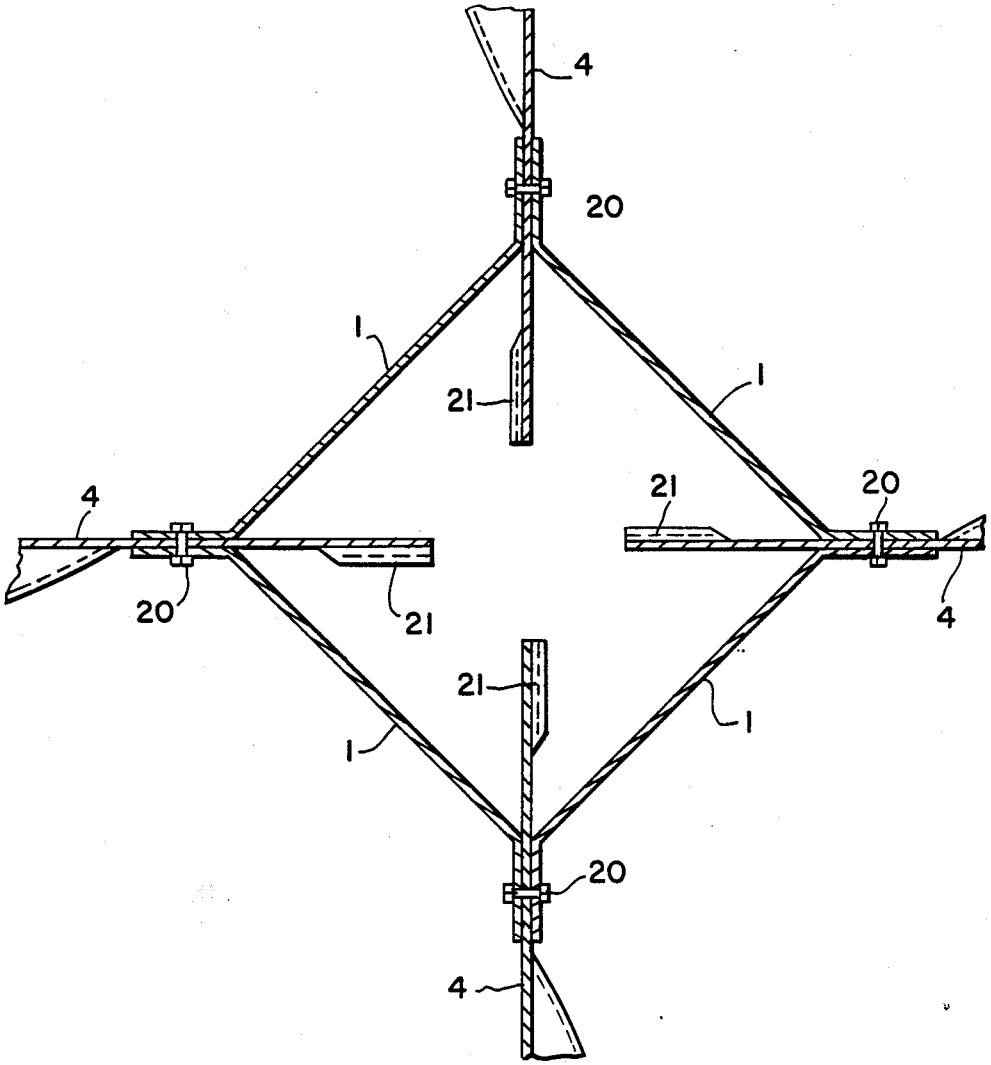
FIG. 3 is a horizontal section through one column of a silo constructed in accordance with the present invention.

FIG. 3 depicts, in section,a diamond shaped column comprised of four basic building elements 1 sandwiching four wall members 4. It should be appreciated that the through bolting which occurs at 20 is a relatively simple operation which secures adjacent basic building elements as well as the sandwiched vertical flange of one panel. It is not necessary for a workman to place his hand within the column in order to do up the bolt and this facilitates fast construction. The embodiment depicted in FIG. 3 additionally discloses wall members 4 having elongated vertical flanges terminating in a pressed corrugation at 21. This corrugation 21 is intended to add further rigidity to the system where a column is subsequently filled with concrete 23.

It has been found that the wall panels and the basic and other building elements of the column may be fabricated from mild steel although high tensile hot rolled 340 steel has been successfully tested.

The claims defining the invention are as follows:

1. A silo comprising a plurality of support columns and walls, each of said walls including at least one wall plate having profiled strengthening sections and flat flanges around its periphery, said flat flanges having first boreholes for receiving attaching means, wherein at least one said flange is offset on at least one peripheral edge of said wall plate, each of said support columns being formed by at least one plate-shaped building element, said building element comprising a column plate having a flange at each opposite longitudinal edge thereof, said flanges being at approximately 45 degrees from said plate, the included angle between the flanges being approximately 90 degrees, said flanges having second boreholes for receiving attaching means, wherein a flat flange of each of said wall plates is sandwiched between a flange of a said building element and an additional flange of an additional said building element selected from the group consisting of a second said building element, a flat-surfaced building element having said additional flange at a longitudinal edge thereof, and a right-angled building element having said additional flange at a longitudinal edge thereof, said additional flange having third boreholes for receiving attaching means, such that said first, second and third boreholes align to receive attaching means, and wherein said offset allows said wall plate to abut a second wall plate, said first boreholes of said wall plates aligning to receive attaching means.

2. A silo according to claim 1, wherein said plate-shaped building element and said additional building element sandwiching said flat flange are vertically offset relative to each other.

3. A silo according to claim 1, wherein each of said plates of said walls has corrugations at the flat flanges, said corrugations extending into the supporting column formed by said at least one plate-shaped building element.

4. A silo according to claim 1, wherein at least one of said support columns is filled with concrete.

* * * * *